United States Patent [19]

Matthias et al.

[11] Patent Number: 4,808,837

[45] Date of Patent: Feb. 28, 1989

[54] SUBMERSIBLE ELECTRICAL POWER SUPPLY

[75] Inventors: Brian P. Matthias; Richard Mursinna; Daniel Gravitz, all of San Diego, Calif.

[73] Assignee: Honeywell Inc., Minneapolis, Minn.

[21] Appl. No.: 830,396

[22] Filed: Feb. 18, 1986

[51] Int. Cl.[4] ..... F03B 13/08

[52] U.S. Cl. ..... 290/54; 290/52; 290/53; 310/89; 350/96.2

[58] Field of Search ..... 290/42, 43, 44, 52, 290/53, 54, 55; 310/62, 63, 87, 88, 89; 417/175; 350/96.1, 96.14, 96.16, 96.20, 96.23, 96.24

[56] References Cited

U.S. PATENT DOCUMENTS

| | | | |
|---|---|---|---|
| 1,648,848 | 11/1927 | Huguenin | 290/42 X |
| 3,527,954 | 9/1970 | Hoffman | 350/96.1 X |
| 3,566,127 | 2/1971 | Hafner | 350/96.1 X |
| 3,603,804 | 9/1971 | Casey | 290/42 |
| 3,848,171 | 11/1974 | Speth et al. | 290/52 X |
| 3,988,592 | 10/1976 | Porter | 290/53 |
| 3,995,169 | 11/1976 | Oddon | 350/96.1 X |
| 4,069,838 | 1/1978 | Hansel et al. | 350/96.24 X |
| 4,078,388 | 3/1978 | Atencio | 290/53 X |
| 4,117,676 | 10/1978 | Atencio | 290/52 X |
| 4,122,381 | 10/1978 | Sturm | 290/52 X |
| 4,163,905 | 8/1979 | Davison | 290/54 |
| 4,188,546 | 2/1980 | Kossler | 290/52 |
| 4,188,788 | 2/1980 | Eller | 290/52 X |
| 4,301,375 | 11/1981 | Anderson | 290/52 X |
| 4,352,037 | 9/1982 | Santner | 310/89 |
| 4,352,989 | 10/1982 | Atencio | 290/53 |
| 4,398,095 | 8/1983 | Ono | 290/53 |
| 4,399,563 | 8/1983 | Greenberg | 350/96.16 X |
| 4,402,790 | 9/1983 | Lynn et al. | 350/96.1 X |
| 4,437,017 | 3/1984 | Osterberg | 290/52 |
| 4,445,046 | 4/1984 | Allegre et al. | 290/52 |
| 4,467,216 | 8/1984 | Murphy | 415/10 X |
| 4,475,334 | 10/1984 | Kuwabara | 290/43 X |
| 4,496,845 | 1/1985 | Ensign et al. | 290/43 |
| 4,547,774 | 10/1985 | Gould | 350/96.2 X |
| 4,547,869 | 10/1985 | Savit | 350/96.23 X |
| 4,598,290 | 7/1986 | Collins et al. | 350/96.2 X |

*Primary Examiner*—William M. Shoop, Jr.
*Assistant Examiner*—Paul Ip
*Attorney, Agent, or Firm*—William T. Udseth

[57] ABSTRACT

An electrical generator in a water impermeable housing is driven by a water driven motor. The combination can be submersed with power delivered from the generator to a hydro-subsystem. The system is intrinsically safe in that all electronics are submerged during operation, thus any sparks emitted will not trigger secondary explosions in the surrounding environment. The supply is particularly useful in conjunction with submersible, remotely operated vehicles (ROVs), and diver assist power supply.

6 Claims, 2 Drawing Sheets

SUBMERSIBLE ELECTRICAL POWER SUPPLY

BACKGROUND OF THE INVENTION

1. Field of the Invention

This invention relates to submersible power supplies wherein electrical power is generated by hydro-motive force and the electronics are contained in a water tight housing.

2. Related Art

Many environments requiring a supply of electrical power to an underwater site are hazardous due to the presence of flammable materials at the power supply site. In such environments a single spark can cause a fire or even an explosion.

The presence of oil or toxic fumes either on deck or in the holds make an oil tanker a particularly dangerous environment for the generation of electrical power. In order to inspect and/or clean the tanks or holds of large oil tankers, it is desirable to employ a remotely operated undersea vehicle (ROV) to minimize inefficient manual procedures. Almost all ROVs require the generation of electrical power. While electrical generation systems exist which attempt to isolate the electronics from their surrounding environment, they all generate the electrical power above the surface of the water. Any sparks which escape from such systems are a substantial hazard.

It is highly desirable to provide electrical energy in hazardous environments in an intrinsically safe manner. That is, if the source of energy ignites or explodes, a secondary explosion should not occur in the environment.

It is therefore an object of the present invention to provide a system which supplies electrical power to an underwater site without the presence of electrical components above the surface.

It is a further object of the present invention to provide an intrinsically safe system for supplying electrical power to an underwater site.

It will be seen how these and other objects are achieved by the following description.

SUMMARY OF THE INVENTION

The present invention is an electrical power supply wherein all electrical components are submersed in water.

An electrical generator is housed in a container sealed against water. The generator is coupled underwater to a hydro-motive force supply (i.e., a means for producing force solely in response to fluid pressure). The hydro-motive force is converted by the generator to electrical power which is thereafter transmitted along a power cable to a hydro-subsystem.

The water supply of a ship can serve as a hydro-motive force supply. The present invention is particularly adapted for use with a ROV. In such an application, preferably a fiber optic cable is coupled to the power supply to transmit data and control signals between the ROV and a remote site. The fiberoptic cable is preferably combined in a single tether with the power cable to the ROV.

DESCRIPTION OF THE PREFERRED EMBODIMENT

Figure 1:
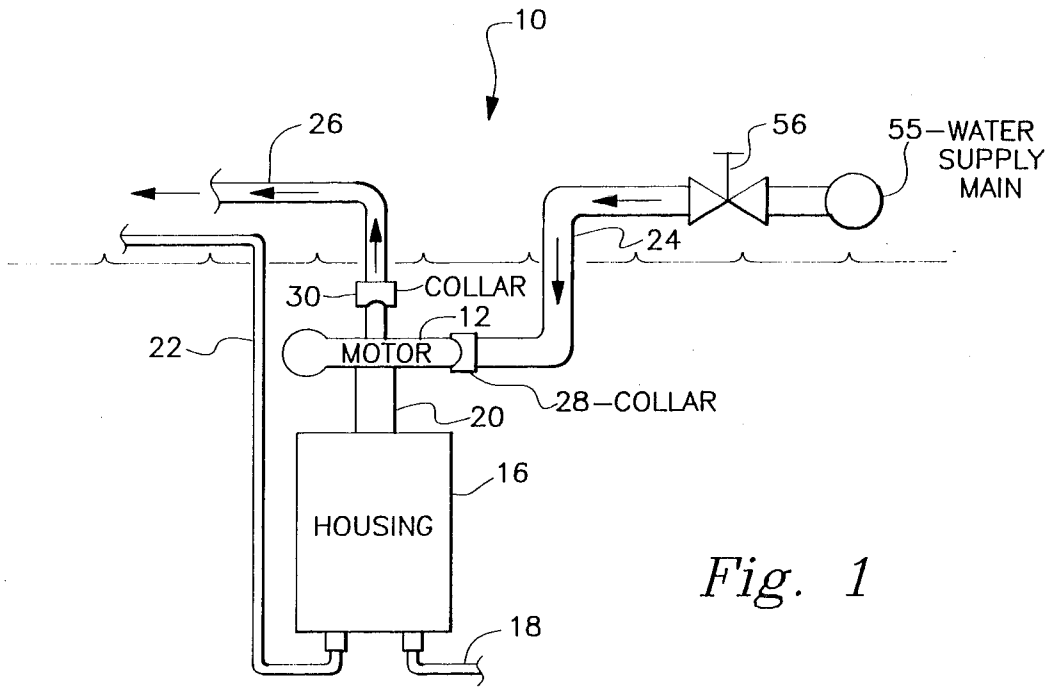
FIG. 1 is a schematic of the submersible electrical power supply.

Submersible electric power supply 10 of FIG. 1 includes a means for producing force solely in response to fluid pressure (i.e., hydro-motive force means 12), means for converting hydro-motive force to electrical energy (such as generator 14 of FIG. 2), a water impermeable housing 16 for holding generator 14 and a means for transmitting the electrical energy (such as cable 18) to a subsystem, such as a ROV (not shown). Housing 16 is typically designed to provide a one atmosphere environment. Hydro-motive force means 12 can be alternatively described as a fluid driven force means that does not respond to or employ electrical energy.

Preferably a coupling member 20 serves as an interface for the hydro-motive force means 12 and generator 14. The coupling is filled with oil for reasons discussed below.

Power supply 10 may also include a means for propagating optical signals 22 so that optical signals or optical data can be transmitted between a remote location and the subsystem. Optical signal means 22 is preferably a fiber optic waveguide which combines with cable 18 at housing 16 to provide a single tether for power and communication to the subsystem. Fluid can be supplied through hoses 24 and 26 to hydro-motive force means 12 from, for example, a water supply of a ship. The hoses are coupled to means 12 by collars 28 and 30.

Figure 2:
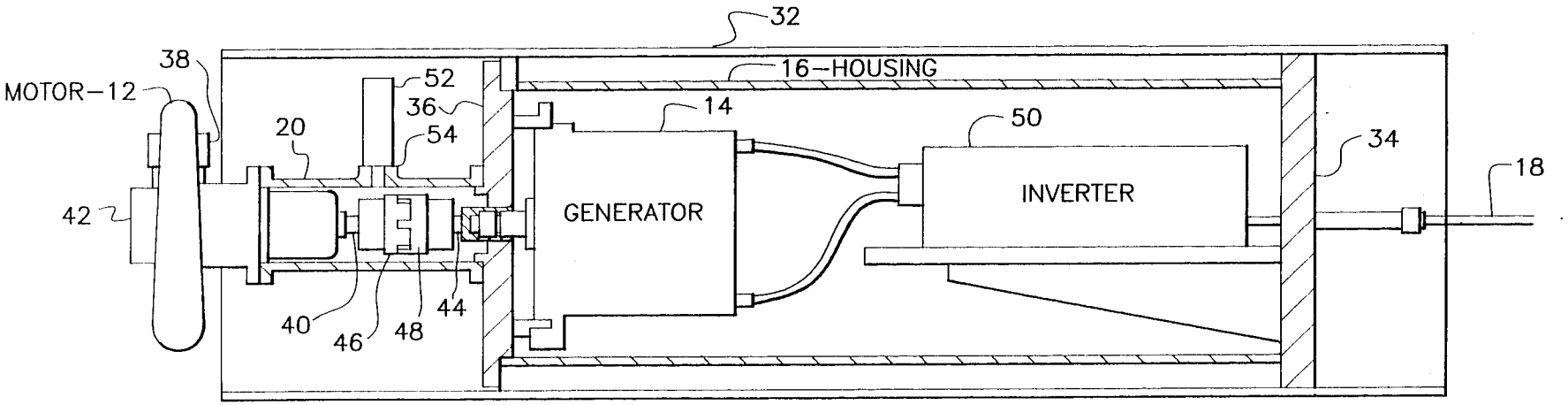
FIG. 2 is cutaway of a portion of FIG. 1.

FIG. 2 displays details of a convenient power supply in accordance with the present invention. Similar structure in the Figures is like-numbered for clarity.

A polyvinyl-chloride sheath 32 covers container 16 and coupler 20 to prevent sparking if either component scrapes against metal while power supply 10 is being positioned. Container 16 is constructed of an anodized aluminum cylinder capped at opposite ends by plates 34 and 36.

Generator 14 is shown within container 16. Generator 14 can be selected to provide whatever form of electrical energy is desired. An alternator could be used to directly provide an A.C. signal. In the example of FIG. 2 however, generator 14 is a D.C. generator supplying about 24 volts. It is also a generator which can operate at several thousand revolutions per minute (e.g., a Leece Neville model 3627JC generator) to accommodate the high rpm capability of commercially available, rugged water driven motors. Such a motor is used as hydro-motive force means 12. A reaction type water driven motor (i.e., wherein the water can discharge against a back pressure and be piped away to a convenient point) operating at several thousand rpms was employed as means 12 (i.e., a Gilkes model 325 F). Water enters input port 38 of motor 12, spirals around the casing, striking internal vanes (not shown) to turn shaft 40 and exit out centrally located port 42.

The rotor shaft 44 of generator 14 is coupled to shaft 40 by two metal interfaces 46 and 48 which provide interlocking teeth through a rubber coupling. Coupling 20 houses the interfacing and connects, by way of seals (not shown), to the casing of motor 12 and end plate 36.

As indicated above, oil fills coupling 20. If a leak occurs in the shaft seals (not shown) between end plate 36 and coupling 20, this insures that oil, not water, will leak into housing 16. Further, the oil serves to lubricate the bearings supporting shaft 40 and helps conduct heat away from shaft seal components which are heated due to the rotation of shafts 40 and 44.

The fluid pressure in coupling 20 is preferably set by filling the main chamber of coupling 20 to the desired pressure. When coupling 20 is submersed there may be a slight reduction in oil fluid volume due to the compressibility of the oil and the oil being forced into small trapped air pockets inside coupling 20. It is convenient to compensate for this projected volume change by attaching a flexible plastic tube 52 to port 54 in the sidewall of coupling 20, with a predetermined amount of oil inside. The amount of oil in tube 52 is such that when tube 52 and main chamber of coupling 20 are submersed, sufficient oil can be pressed from tube 52 into coupling 20 (as tube 52 flattens) to keep coupling 20 full.

For a particular application, it is desired to output an A.C. sine wave from container 16 to an ROV. In this case the 24 volts D.C. from generator 14 is converted to an A.C. sine wave and stepped up to 120 volts by a transformer (not shown) in inverter 50. An example of a useful commercial inverter is a KGS electronics model SPS-1307. The invention is particularly useful in combination with the ROV described in the U.S. patent application entitled "Submersible ROV for Cleaning and Inspecting Metal", filed of even date and assigned to the assignee of the present application; this other patent application being incorporated herein by reference.

In operation, device 10 is connected to hoses 26 and 28 and submerged. Hydro-motive force is supplied to power supply 10 by, for example, connecting a water supply main 55 to hose 24 through valve 56. The water pressure (see arrows in FIG. 1) drives motor 12 which turns the rotor shaft 40 of the power converting means thereby generating the electrical energy. The energy is modified, if necessary, to provide the desired form of electrical power and the same is transmitted along cable 18 to the subsystem.

The present invention is particularly suited as an electrical power supply for submerged subsystems. When the subsystem and power supply 10 are submerged, if a fire or explosion occurs in electrical supply 10 or any part of the subsystem, no spark or flame can ignite a secondary explosion in the explosive gases above the water. The electrical supply 10 and subsystem are thus intrinsically safe.

It is clearly also desirable to minimize or eliminate electronic components in the water main supply 55 or at least in that portion of the water supply system exposed to the hazardous environment.

If one uses the present invention to provide power to a subsystem working underwater in oil tanker holds, electrical supply 10 will typically be lowered into the water in the hold and the ships water main 55 used to drive motor 12.

Electrical supply 10 is preferably highly portable, with its weight selected to allow transport with light equipment. If desired, electrical supply 10 can be designed to maintain its position at a selected depth by attaching floatation devices, ballast tanks, etc. Often, however, surface supports such as hoses 24 and 26 will suffice.

What is claimed is:

1. An electrical energy supply which is submersible in water, comprising:

means for producing a force, wherein said force is produced solely in response to fluid pressure;

means for converting said force to electrical energy;

housing means for containing said force converting means, said housing means being impermeable to water, wherein said housing means is submerged during operation of said force converting means; and means for transmitting said electrical energy to a device which functions in water, wherein all of said transmitting means is submerged in said water during transmission of said electrical energy.

2. The electrical supply of claim 1, further including:

means for propagating optical data underwater; and means for holding a portion of said optical data propagating means and a portion of said electrical energy transmitting means together, so that substantially a single tether is provided from said housing to said device.

3. A portable electrical energy supply which is submersible in water, comprising:

means for supplying a force from a surface location, wherein said force is produced solely in response to fluid pressure;

means for converting said force to electrical energy;

means for coupling said force supply means and said force converting means;

means for containing said force converting means, said containing means being impermeable to water and submerged in water during operation of said electrical energy supply; and means for transmitting said electrical energy to a device which functions in water, wherein all of said transmitting means is submerged in water during transmission of said electrical energy.

4. A method of supplying electrical energy from a remote underwater site to a device which functions in water, comprising the steps of:

providing a means for producing a force solely in response to fluid pressure;

placing a means for converting said force to electrical energy, in a water impermeable container;

transporting said container and force converting means to said underwater site;

supplying fluid pressure to said force producing means at said underwater site;

converting said force to electrical energy, said converting being performed underwater; and transmitting said electrical energy to said device, wherein all of said transmitting occurs underwater; and wherein said supply can be transported to a further underwater site if desired.

5. The method of claim 4 further including:

generating optical control signals for said device; and transmitting said optical control signals to said device along a path, wherein a portion of said path extends from said container to said device and said portion of said path is coextensive with the transmission route of said electrical energy to said device.

6. The supply of claim 1 wherein said force producing means is capable of responding to high flow rates of water.

* * * * *